US006808412B2

(12) United States Patent
Ishii

(10) Patent No.: US 6,808,412 B2
(45) Date of Patent: Oct. 26, 2004

(54) CABLE CONNECTOR

(75) Inventor: Yoshiharu Ishii, Yokohama (JP)

(73) Assignee: Yamaichi Electronics Co., Ltd., Tokyo (JP)

( * ) Notice: Subject to any disclaimer, the term of this patent is extended or adjusted under 35 U.S.C. 154(b) by 0 days.

(21) Appl. No.: 10/431,568

(22) Filed: May 8, 2003

(65) Prior Publication Data

US 2003/0211773 A1 Nov. 13, 2003

(30) Foreign Application Priority Data

May 9, 2002 (JP) ..... 2002-134691

(51) Int. Cl.[7] ..... H01R 12/24
(52) U.S. Cl. ..... 439/495; 439/260
(58) Field of Search ..... 439/492–498, 439/260, 347

(56) References Cited

U.S. PATENT DOCUMENTS 3,522,652 A * 8/1970 Gordon ..... 29/883
4,235,500 A * 11/1980 Belopavlovich et al. .... 439/495
4,934,947 A * 6/1990 Brummans ..... 439/77
4,948,378 A * 8/1990 Hoshino ..... 439/271
5,076,803 A * 12/1991 Mutarelli et al. ..... 439/493
5,213,534 A * 5/1993 Gardner et al. ..... 439/495
5,562,487 A * 10/1996 Ii et al. ..... 439/495
5,738,545 A * 4/1998 Igarashi et al. ..... 439/607
5,993,247 A * 11/1999 Kidd ..... 439/495
6,022,242 A * 2/2000 Suzuki ..... 439/495
6,056,572 A * 5/2000 Matsumoto et al. ..... 439/260
6,375,486 B1 * 4/2002 Yu ..... 439/347
6,503,096 B2 * 1/2003 Aoki ..... 439/496

FOREIGN PATENT DOCUMENTS

JP 7-326439 12/1995
JP 11-339886 12/1999

* cited by examiner

*Primary Examiner*—Tho D. Ta
*Assistant Examiner*—Larisa Tsukerman
(74) *Attorney, Agent, or Firm*—Finnegan, Henderson, Farabow, Garrett & Dunner, LLP

(57) ABSTRACT

One end of the flexible printed circuit is electrically connected with the contact terminals of the cable accommodation portion in the connector body by the engagement of the end face of the stopper member biased by the elastic force of the leaf springs with the step of the back panel in the flexible printed circuit.

10 Claims, 22 Drawing Sheets

CABLE CONNECTOR

This application claims priority from Japanese Patent Application No. 2002-134691 filed May 9, 2002, which is incorporated hereinto by reference.

BACKGROUND OF THE INVENTION

1. Field of the Invention

The present invention relates to a cable connector for electrically connecting one end of a cable to a circuit board.

2. Description of the Related Art

When electric components are electrically connected to each other in the interior of an electronic apparatus, a cable connector is in practical use. The cable connector electrically connects electrical components to a printed circuit board via a flexible flat cable (FFC) or a flexible printed circuit (FPC). As the cable connector, for example, a rotary type or a slide type which is different from each other in the manner of fixation of the cable is in practical use. As shown in FIGS. 21A and 21B, the cable connector of the rotary type includes, for example, a connector body 4 having a cable accommodation portion 12 disposed on a printed circuit board 2, a plurality of contact terminals 10*ai* (i=1 to n wherein n is a positive integer) for electrically connecting an electrode section of the printed circuit board 2 with a terminal section 6E of a flexible printed circuit 6, and a stopper member 8 supported in a rotational movably manner relative to the connector body 4, for carrying out the detachment and attachment of the terminal section of the flexible printed circuit 6 relative to the contact portion of the contact terminals 10*ai*.

The connector body 4 has at one end thereof an inserting opening 14 through which the terminal section of the flexible printed circuit 6 connected to the connector body 4 passes. The inserting opening 14 communicates with the cable accommodation portion 12 formed in the interior of the connector body 4. The cable accommodation portion 12 is defined by being encircled with an inner wall of the connector body 4. A bottom opposed to the printed circuit board 2 in the cable accommodation portion 12 is opened. In a portion of the connector body 4 forming an upper part of the cable accommodation portion 12, opposite side ends of a proximal end portion of the stopper member 8 are respectively supported in a rotational movably manner. The stopper member 8 has a pressing surface 8*a* in a portion opposed to the cable accommodation portion 12, which touches to a back panel section 6B of the flexible printed circuit 6 described later and pressing the same toward the contact section of the contact terminals 10*ai*.

The plurality of contact terminals 10*ai* are arranged in the cable accommodation portion 12 in correspondence to the array of the terminal section 6E of the flexible printed circuit 6. The respective contact terminal 10*ai* is comprised of a stationary terminal section 10S soldered to the terminal section of the printed circuit board 2, a bifurcated stopper section 10B and movable terminal section 10A, and a coupled section 10C for coupling a confluence portion of the stopper section 10B and the movable terminal section 10A with the stationary terminal section 10S.

A front end of the stopper portion 10B of the respective contact terminal 10*ai* is located to face a recess of the stopper member 8. Thereby, as shown in FIG. 21A, when a front end of the stopper member 8 is away from the cable accommodation portion 12; that is, when the stopper member 8 is in an unlocked state, the front end of the stopper 10B is engageable with the peripheral edge of the recess of the stopper member 8 to restrict an opening angle of the stopper member 8.

The movable terminal section 10A has a contact portion at a front end thereof for the electrical connection with the terminal section 6E of the flexible printed circuit 6.

The coupled section 10C is fixed to the connector body 4 by press-fitting a projection thereof into a slit formed adjacent to the cable accommodation portion 12 of the connector body 4.

According to such a structure, when the terminal section 6E of the flexible printed circuit 6 is electrically connected to the contact portion of the respective contact terminal 10*ai*, as shown in FIG. 21A, after the terminal section 6E of the flexible printed circuit 6 is inserted in the direction shown by an arrow F into the inserting opening 14 to a position in the vicinity of a back wall 4*a* defining a rear side of the cable accommodation portion 12, the front end of the stopper member 8 is made to rotationally move in the direction shown by an arrow L. Thus, the terminal section 6E of the flexible printed circuit 6 is pressed onto the contact portion of the movable terminal section 10A of the contact terminal 10*ai* by the pressing surface 8*a* of the stopper member 8 and electrically connected thereto. At that time, the terminal section 6E of the flexible printed circuit 6 is nipped by the pressing surface 8*a* of the stopper member 8 and the movable terminal section 10A of the respective contact terminal 10*ai* which carried out elastic displacement.

As shown in FIGS. 22A and 22B, the sliding type cable connector includes, for example, a connector body 18 having a cable accommodation portion 16 disposed on a printed circuit board 2, a plurality of contact terminals 20*ai* (i=1 to n wherein n is a positive integer) for electrically connecting an electrode section of the printed circuit board 2 with a terminal section 6E of a flexible printed circuit 6, and a stopper member 22 supported in a slidable manner relative to the connector body 18, for carrying out the detachment and attachment of the terminal section 6E of the flexible printed circuit 6 relative to the contact portion of the contact terminals 20*ai*.

The connector body 18 has at one end thereof an inserting opening 24 through which the terminal section 6E of the flexible printed circuit 6 connected to the connector body 18 passes. The inserting opening 24 communicates with the cable accommodation portion 16 formed in the interior of the connector body 18. The cable accommodation portion 16 of the connector body 18 is defined by being encircled with an inner wall of the connector body 18. A guide groove 18*g* for supporting opposite ends of the stopper member 22 in a slidable manner is formed on the inside of the connector body 18 in which an upper part of the cable accommodation portion 16 is formed in the attachment/detachment direction of the flexible printed circuit 6. The stopper member 22 has, in a portion opposed to the cable accommodation portion 16, a pressing surface 22*a* for pressing a back panel 6B of the flexible printed circuit 6 toward the contact section of the contact terminal 20*ai* described later, while sliding the back panel 6B along a back panel 6B of the flexible printed circuit 6.

A guiding surface 22*b* having a slant portion 22*s* at the midpoint thereof is formed in a portion opposite to the pressing surface 22*a* of the stopper member 22.

The plurality of contact terminals 20*ai* are arranged in the cable accommodation portion 16 in correspondence to the array of the terminal section 6E of the flexible printed circuit 6. The respective contact terminal 20*ai* is comprised of a stationary terminal section 20S soldered to the terminal section of the printed circuit board 2, a bifurcated guiding piece 20B and movable terminal section 20A, and a coupled section 20C for coupling a confluence portion of the guiding piece 20B and the movable terminal section 20A with the stationary terminal section 20S.

A front end of the guiding piece 20B of the respective contact terminal 20*ai* is disposed to face the guiding surface 22*b* of the stopper member 22. The movable terminal section 20A has, at a front end thereof, a contact section for the electrical connection with the terminal section 6E of the flexible printed circuit 6.

The coupled section 20C is fixed to the connector body 18 by press-fitting a projection thereof into a slit formed adjacent to the cable accommodation portion 16 of the connector body 18.

Thus, as shown in FIG. 22A, when the slant portion 22*s* of the stopper member 22 is away from the cable accommodation portion 16; that is, in the unlocked state, the slant portion 22*s* of the stopper member 22 is away from the guiding piece 20B to be in the disengaged state. Accordingly, the terminal section 6E of the flexible printed circuit 6 can be inserted into the cable accommodation portion 16 through the inserting opening 24.

In this structure, upon the occasion of the electrical connection between the terminal section 6E of the flexible printed circuit 6 and the contact section of the respective contact terminal 20*ai*, when the slant portion 22*s* of the stopper member 22 is away from the cable accommodation portion 16 as shown in FIG. 22A, the terminal section 6E of the flexible printed circuit 6 is inserted through the inserting opening 24 in the direction shown by an arrow F to a position in the vicinity of the rear wall 18*a* defining a rear side of the cable accommodation portion 16, after which a front end of the stopper member 22 is made to slide in the direction shown by an arrow L. Accordingly, the terminal section 6E of the flexible printed circuit 6 is pressed onto the contact section of the movable terminal section 20A of the contact terminal 20*ai* by means of the pressing surface 22*a* of the stopper member 22 to establish the electrical connection.

At that time, the terminal section 6E of the flexible printed circuit 6 is nipped between the pressing surface 22*a* of the stopper member 22 and the movable terminal section 20A of the elastically deformed each contact terminal 20*ai*.

In the above-mentioned rotary type or sliding type cable connector, immediately before the terminal section 6E of the flexible printed circuit 6 is held to the movable terminal section of the respective contact terminal 10*ai* or 20*ai*, the terminal section 6E is made to move from a position shown by a chain double-dashed line to another position shown by a solid line in FIG. 21A or 22A due to the mutual frictional force. Accordingly, there might be a risk in that the electrical connection becomes unreliable between the terminal section 6E and the contact section of the movable terminal section in the respective contact terminal 10*ai* or 20*ai*, or it is required to hold other end of the flexible printed circuit 6 so that an end face of the flexible printed circuit 6 does not collide with the rear wall 4*a* or 18*a* or it is needed to operate the stopper member 8 or 22 with the end face of the flexible printed circuit 6 touched.

Also, it is difficult to determine whether or not the terminal section 6E is assuredly connected with the contact portion of the movable terminal section of the respective contact terminal by the operation of the stopper member 8 and 22.

Furthermore, when any load exceeding a predetermined level is applied to the other end of the flexible printed circuit 6 in the direction opposite to the direction shown by an arrow F in FIGS. 21A and 22A, there might be a risk in that the stopper member 8 or 22 is made to rotationally move or slide to result in the unreliable electrical connection between the terminal section 6E of the flexible printed circuit 6.

SUMMARY OF THE INVENTION

In view of the above-mentioned problems, an object of the present invention is to provide a cable connector for electrically connecting one end of a cable to a circuit board, capable of assuredly and easily carrying out the attachment/detachment of the cable as well as avoiding the unreliable electrical connection even if an undesirable load is applied to the cable.

To achieve the above object, a cable connector according to the present invention comprises a cable accommodation portion having contact terminals to be electrically connected to a terminal section provided at one end of a cable together with a portion being engaged; the cable accommodation portion being capable of relative positioning the one end of the cable relative to the contact terminals and accommodating the one end of the cable therein; and a stopper member disposed in the cable accommodation portion to be movable in the thickness direction of the cable to be connected, having an opening for allowing one end of the cable to pass through the opening, an engaging portion to be selectively engageable with an end face of the portion being engaged of the cable inserted into the cable accommodation portion at edge of the opening.

Also, the cable connector may further comprise a biasing member for biasing the stopper member to maintain the engagement of the engaging section of the stopper member with the end surface of the portion being engaged of the cable when the one end of the cable is positioned relative to the contact terminals, and a restricting member for restricting an amount of movement of the stopper member caused by the biasing force of the biasing member.

The biasing member may be a leaf spring which is supported at one end by the stopper member and at the other end by the periphery of the cable accommodation portion.

The cable may be a flexible printed circuit.

The portion being engaged of the cable may be a step formed in a back panel.

A lock/unlock mechanism for carrying out the selective connection of the terminal section of the cable with the contact terminals of the cable accommodation portion may be constituted by the portion being engaged provided at the one end of the cable, the stopper member and the biasing member.

As apparent from the above description, according to the cable connector of the present, by providing the stopper member accommodated in the cable accommodation portion to be movable in the thickness direction of the cable to be connected; the stopper member having an opening for allowing one end of the cable to pass through the same and being provided at the periphery of the opening with the engaging section to be selectively engageable with an end face of the step of the cable inserted into the cable accommodation portion; the engaging section of the stopper member is movable in the thickness direction of the cable and engageable with the end face of the portion being engaged of the cable. Thus, it is possible to assuredly and easily carry out the attachment/detachment of the cable, whereby the unreliable electric connection is avoidable even though an undesirable load is applied to the cable.

The above and other objects, effects, features and advantages of the present invention will become more apparent from the following description of embodiments thereof taken in conjunction with the accompanying drawings.

DETAILED DESCRIPTION OF PREFERRED EMBODIMENTS

Figure 10:
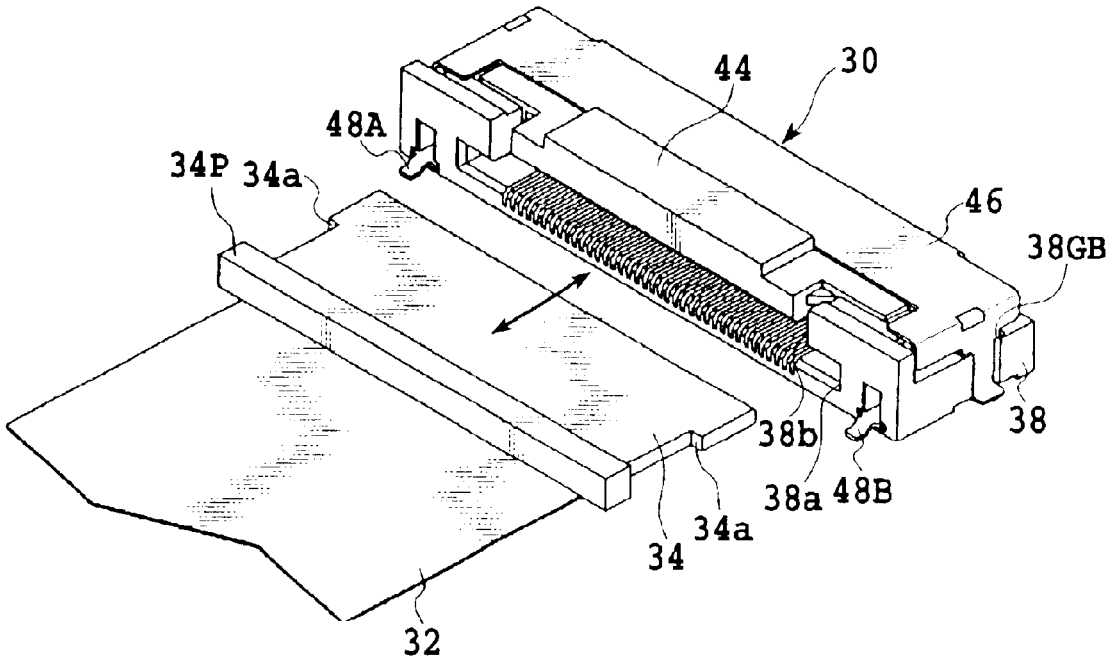
FIG. 10 is a perspective view showing an appearance of one embodiment of the cable connector according to the present invention, together with one end of the cable to be connected.
Figure 11:
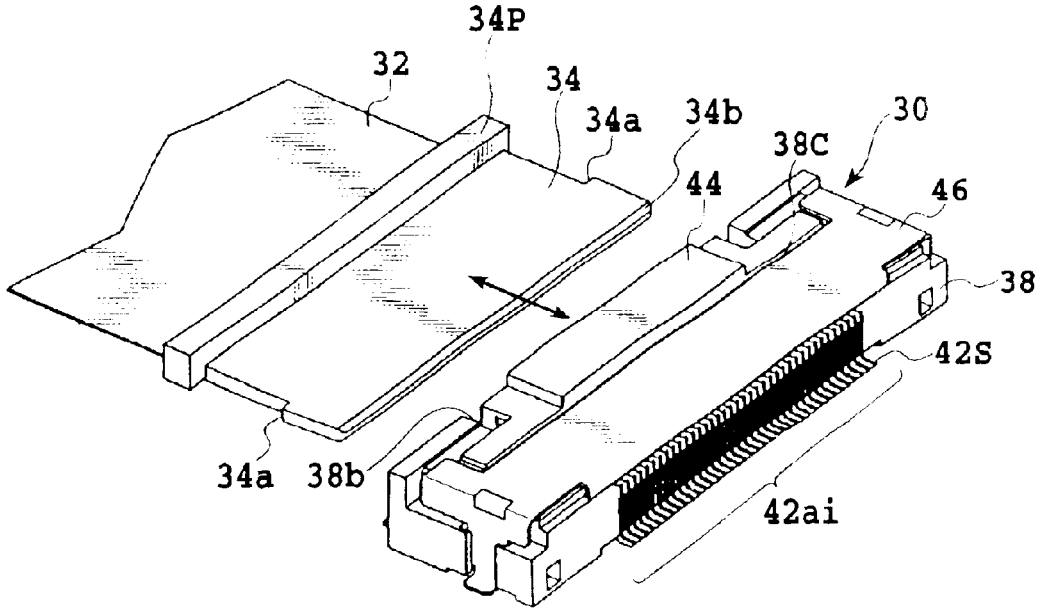
FIG. 11 is a perspective view showing an appearance of one embodiment of the cable connector according to the present invention, together with one end of the cable to be connected.

FIGS. 10 and 11 illustrate an overall structure of one embodiment of a cable connector according to the present invention and a cable used therewith.

In FIG. 10, one end of a cable to be electrically connected to a cable connector 30 is inserted into the cable connector 30 and removed therefrom in the attachment/detachment direction shown by an arrow in FIGS. 10 and 11. The cable is, for example, a flexible printed circuit 32. The flexible printed circuit 32 is referred, for example, to as YFLEX (registered trade mark) in which a plurality of electro-conductive layers covered with a protective layer are formed on an insulating substrate. The insulating substrate may be molded of glass-reinforced epoxy, polyimide (PI), polyethylene terephthalate (PET) or polyether imide (PEI) of approximately 50 $\mu$m in thickness. Also, the electro-conductive layer may be formed of a copper alloy of approximately 12 $\mu$m in thickness. The protective layer may be formed of heat curable resist layer or polyimide film.

Figure 20A:
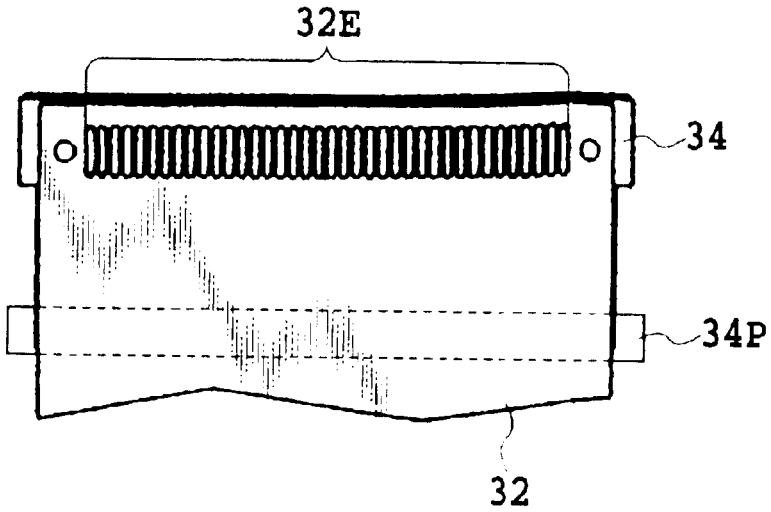
FIG. 20A is a plan view illustrating an appearance of one end of the cable used for the cable connector according to the present invention.
Figure 20B:
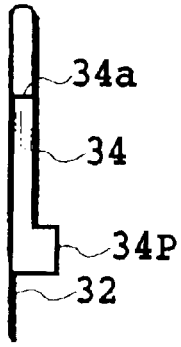
FIG. 20B is a side view of FIG. 20A.
Figure 21A:
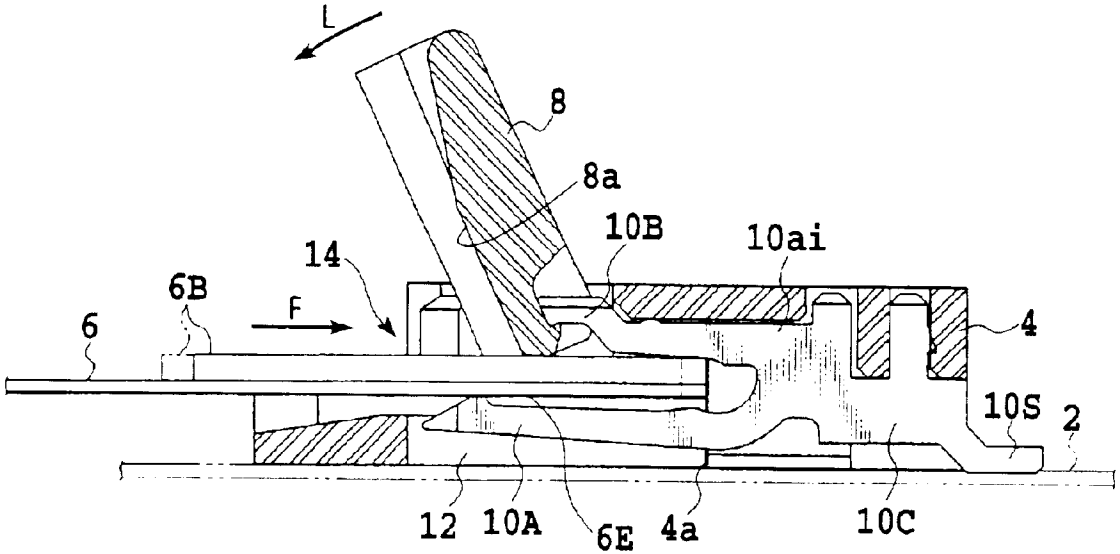
FIG.21A PRIOR ART
FIG. 21A is a sectional view illustrating a conventional rotary type cable connector in which one end of a cable is inserted into a cable accommodation portion.
Figure 21B:
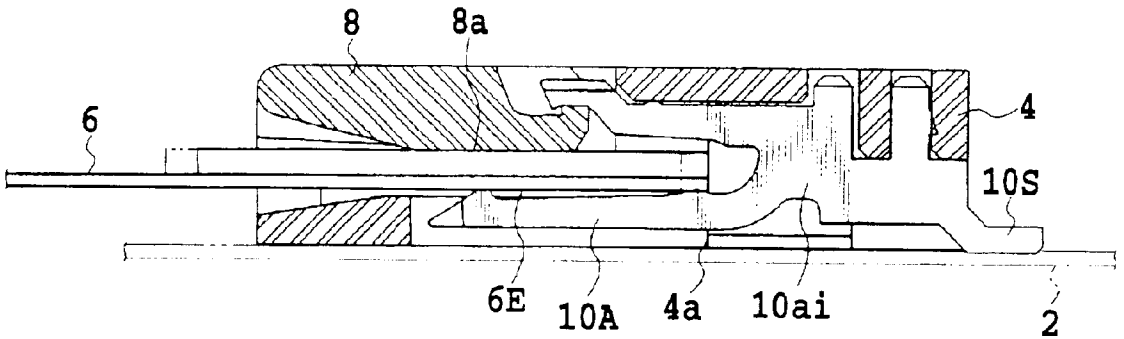
FIG.21B PRIOR ART
FIG. 21B is a sectional view showing the embodiment shown in FIG. 21A in which the one end of the cable has been completely connected.
Figure 22A:
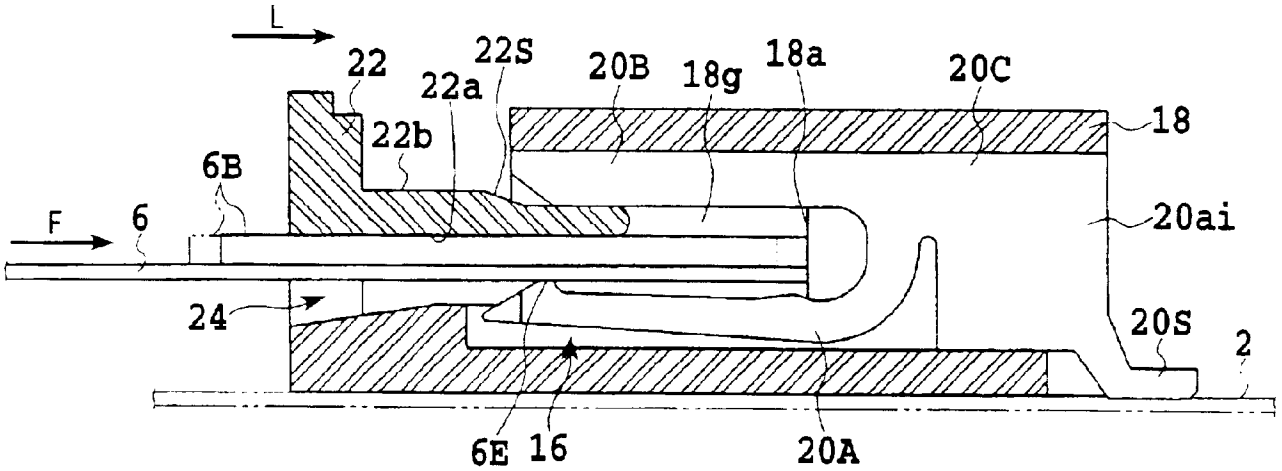
FIG.22A PRIOR ART
FIG. 22A is a sectional view illustrating a conventional sliding type cable connector in which one end of a cable is inserted into a cable accommodation portion.
Figure 22B:
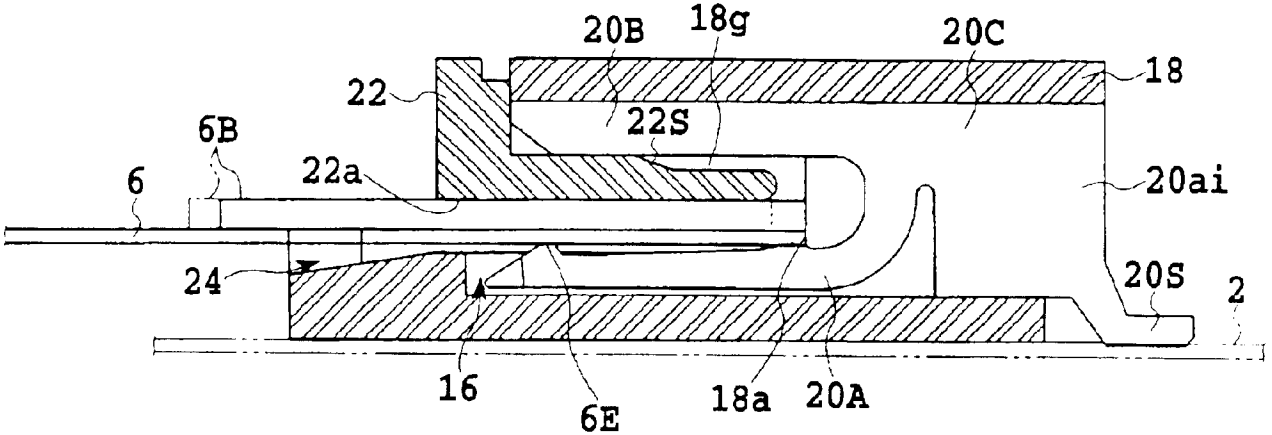
FIG.22B PRIOR ART
FIG. 22B is a sectional view of the embodiment shown in FIG. 22A in which the one end of the cable has been completely connected.

On one surface at one end of the flexible printed circuit 32 to be connected, a back panel 34 is provided as shown in FIGS. 10, 20A and 20B. The back panel 34 is made, for example, of polybutylene terephthalate (PBT) and manufactured to a predetermined thickness. The back panel 34 has a operating portion 34P for facilitating the attachment/detachment of the flexible printed circuit 32. At a front end edge of the back panel 34, a chamfered portion 34*b* is provided as shown in FIG. 11. Also, on the opposite sides of the front end of the back panel 34, step portions 34*a* functioned as portion to be engaged are respectively formed.

As shown in FIGS. 20A and 20B, a group of electrodes 32E consisting of a plurality of electrodes, for example, having a width of 0.3 mm are formed on the other surface of one end of the flexible printed circuit 32. The respective electrodes are formed, for example, at intervals of approximately 0.5 mm. The group of electrodes 32E are electrically connected to the electro-conductive layer in the interior of the flexible printed circuit 32.

Figure 13:
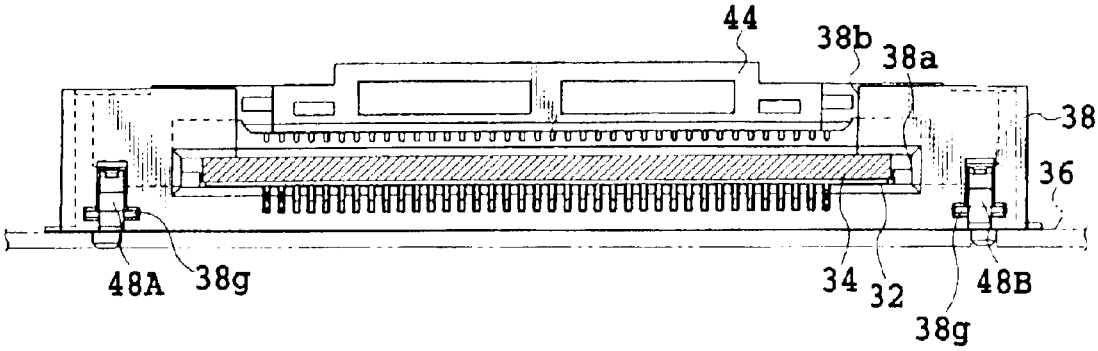
FIG. 13 is a front view of the embodiment shown in FIG. 12.
Figure 14:
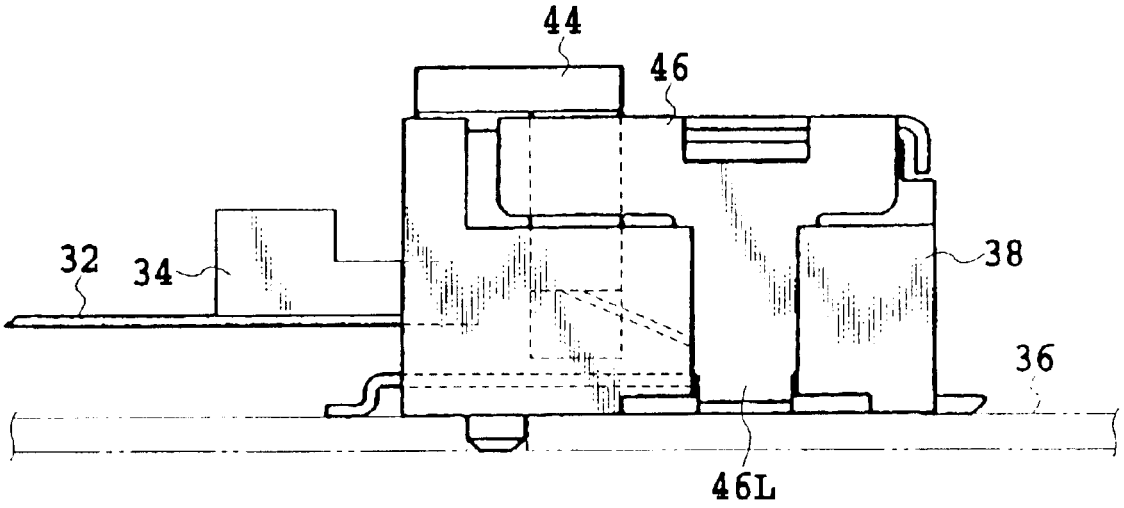
FIG. 14 is a side view of the embodiment shown in FIG. 12.
Figure 15:
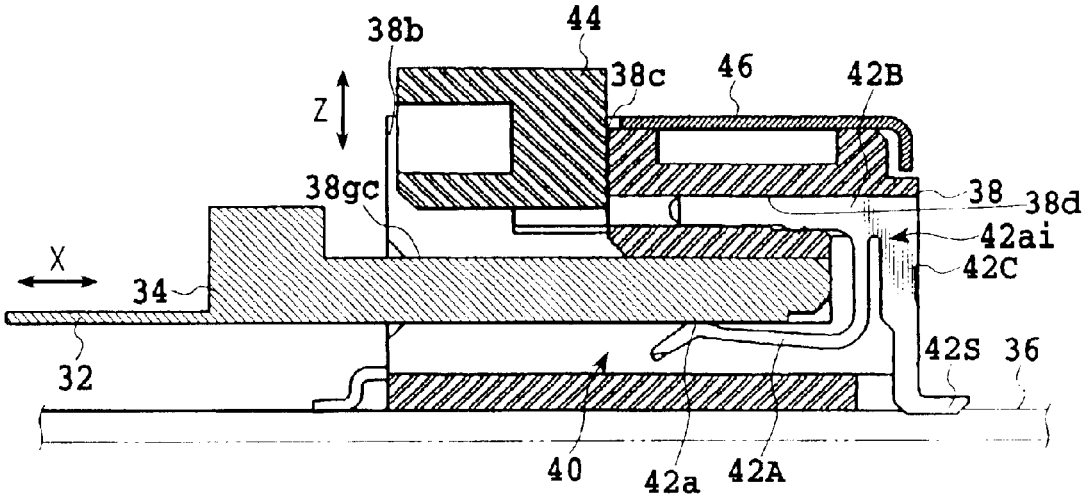
FIG. 15 is a partially sectional view of the embodiment shown in FIG. 14.

As shown in FIGS. 13 and 15, the cable connector 30 is fixed to a predetermined circuit board 36, and includes, as main elements, a connector body 38 having a cable accommodation portion 40 in which one end of the flexible printed circuit 32 is selectively accommodated, a stopper member 44 constructing part of a lock/unlock mechanism described later, which is disposed to be movable upward and downward in the direction shown by an arrow Z in FIG. 15, a plurality of contact terminals 42*ai* (i=1 to n wherein n is a positive integer) disposed in the cable accommodation portion 40 for electrically connecting the group of electrodes 32E on the flexible printed circuit 32 with the conductive layer of the circuit board 36, and a plate member 46 for restricting the uppermost end position of the stopper member 44 relative to the connector body 38.

An elongate opening 38*a* for allowing the group of electrodes 32E and the back panel 34 of the flexible printed circuit 32 to pass through the same is formed at one end of the connector body 38. As shown in FIGS. 11 and 13, notch portions 38*b* are formed on a part of the periphery of the opening 38*a* for receiving a portion of the operating portions of the stopper member 44. The notch portion 38*b* communicates with an opening 38*c* disposed above the cable accommodation portion 40. The opposite ends of the opening 38*a* communicate with guiding grooves 38*gc*, respectively, formed in the inner peripheral wall of the cable accommodation portion 40. The guiding groove 38*gc* extends toward the back surface of the connector body 38 by a predetermined long for guiding the back panel 34 of the flexible printed circuit 32 as shown in FIG. 15.

Figure 18:
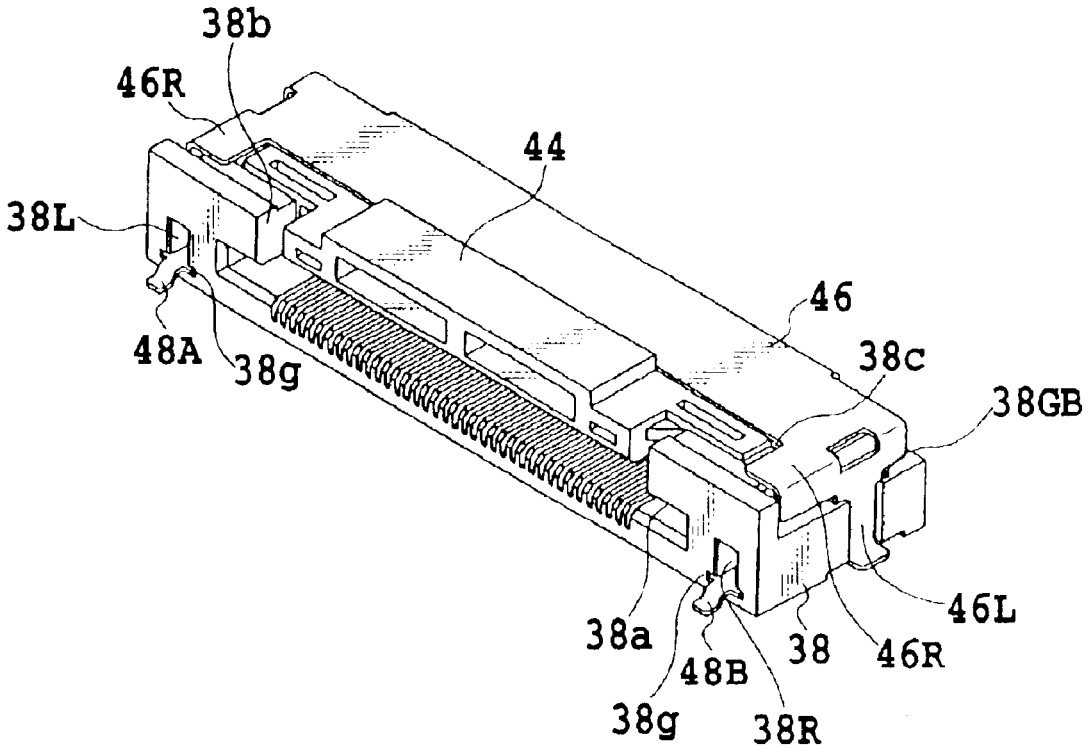
FIG. 18 is a perspective view showing an appearance of one embodiment of the cable connector according to the present invention.
Figure 19:
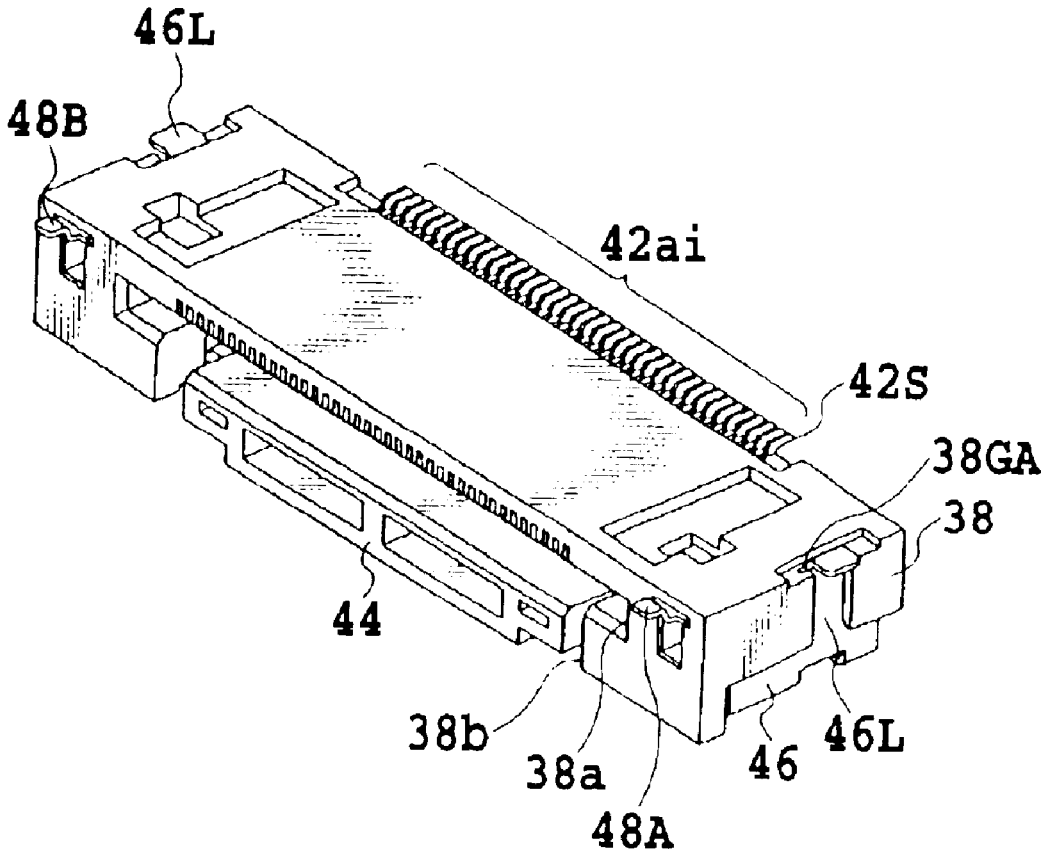
FIG. 19 is a perspective view showing an appearance of a bottom section of the connector body shown in FIG. 1B.

As shown in FIG. 18, on the peripheral edge of the opposite sides of the opening 38*a*, perforations 38R and 38L are formed for inserting leaf springs 48A and 48B (see FIG. 1), respectively, provided in the stopper member 44. The perforations 38R and 38L communicate with the cable accommodation portion 40. In the bottom of the wall defining the perforations 38R and 38L, grooves 38*g* are formed, into which are press-fit one ends of the leaf springs 48A and 48B, respectively.

Figure 12:
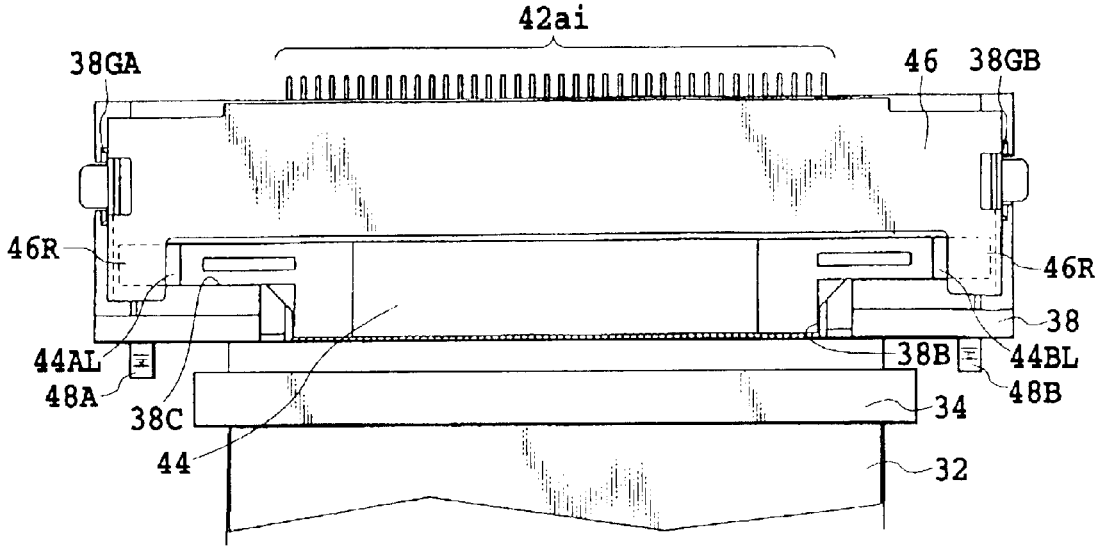
FIG. 12 is a plan view showing an appearance of one embodiment of the cable connector according to the present invention, together with one end of the cable which have been completely connected.

As shown in FIG. 12, vertical grooves 38GA and 38GB are formed, respectively, in the outer periphery of walls defining an edge of the opposite sides of the cable accommodation portion 40 of the cable body 38 so that legs formed at the opposite ends of the plate member 46 are press-fit into the vertical grooves.

In the wall defining the back side of the connector body 38, slits are formed, into which are press-fit connecting portions 42C of the respective contact terminals 42*ai*. The respective slits extend in the longitudinal direction of the connector body 38 at a predetermined mutual interval and communicate with the interior of the cable accommodation portion 40.

As shown in FIG. 15, the respective contact terminal 42*ai* includes a soldered portion 42S to be electrically connected to an electrode pad as an electro-conductive layer of the circuit board 36 by soldering, a movable contact section 42A having a contact section 42*a* to be electrically connected to the group of electrodes 32E of the flexible printed circuit 32, a base 42B to be press-fit into a groove 38*d* communicated to the slit of the connector body 38, and a connecting portion 42C for connecting the movable contact section 42A, the base 42B and the soldered portion 42S.

One end of the base 42B projected into the above-mentioned slit is connected to one end of the movable contact section 42A and to one end of the connecting portion 42C.

A portion connected to the base 42B in the movable contact section 42A having the elasticity bends to be formed at a predetermined distance away from the connecting portion 42C. Thereby, the group of electrodes 32E and the back panel 34 of the flexible printed circuit 32 inserted into the cable accommodation portion 40 are nipped by the contact section 42*a* of the movable contact section 42A, the inner wall defining the upper portion of the cable accommodation portion 40 and the pair of guiding grooves 38*gc*.

The plate member 46 disposed on the upper portion of the outer periphery of the connector body 38 has a flat portion placed on the top of the outer periphery of the connector body 38 and a pair of legs 46L coupled to the opposite sides of the flat portion integral therewith in a bending manner, respectively. As shown in FIG. 12, the respective leg 46L is press-fit and held into the vertical grooves 38GA and 38GB of the connector body 38.

Position-restricting sections 46R for restricting a portion of the stopper member 44 are formed at both ends of the flat portion in the plate member 46 opposed to the stopper members 44. A space between both the position-restricting sections 46R are cut off in correspondence to the opening 38*c* so that the upper portion of the stopper member 44 described later are arranged.

Figure 3:
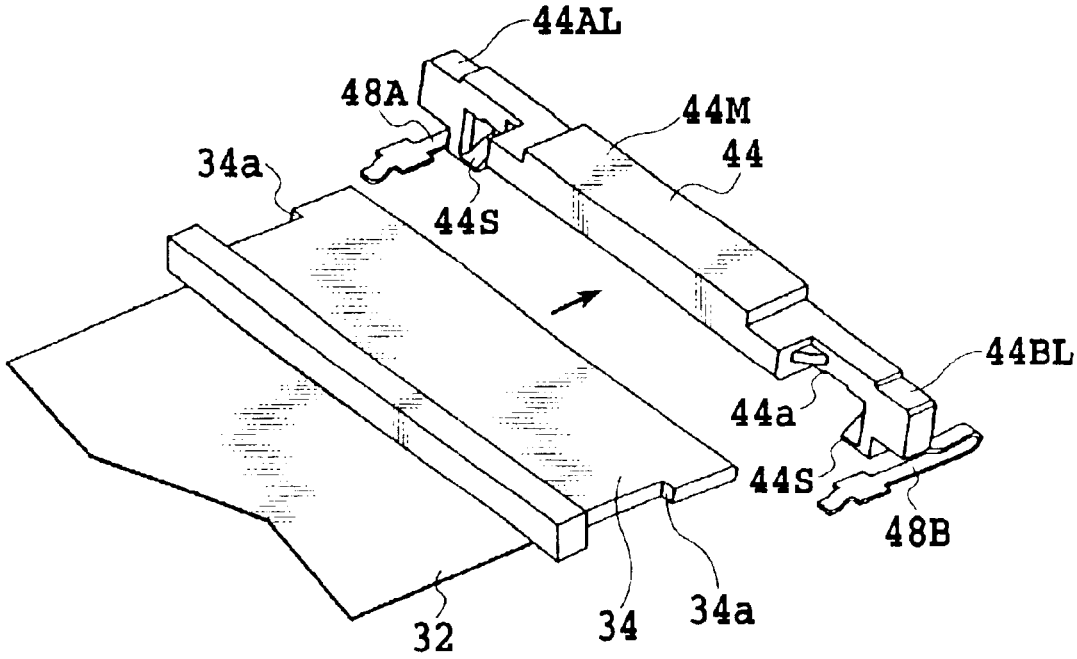
FIG. 3 is a perspective view showing a configuration made up of a cable, a stopper member in the non-connected state in the embodiment shown in FIG. 1.
Figure 4:
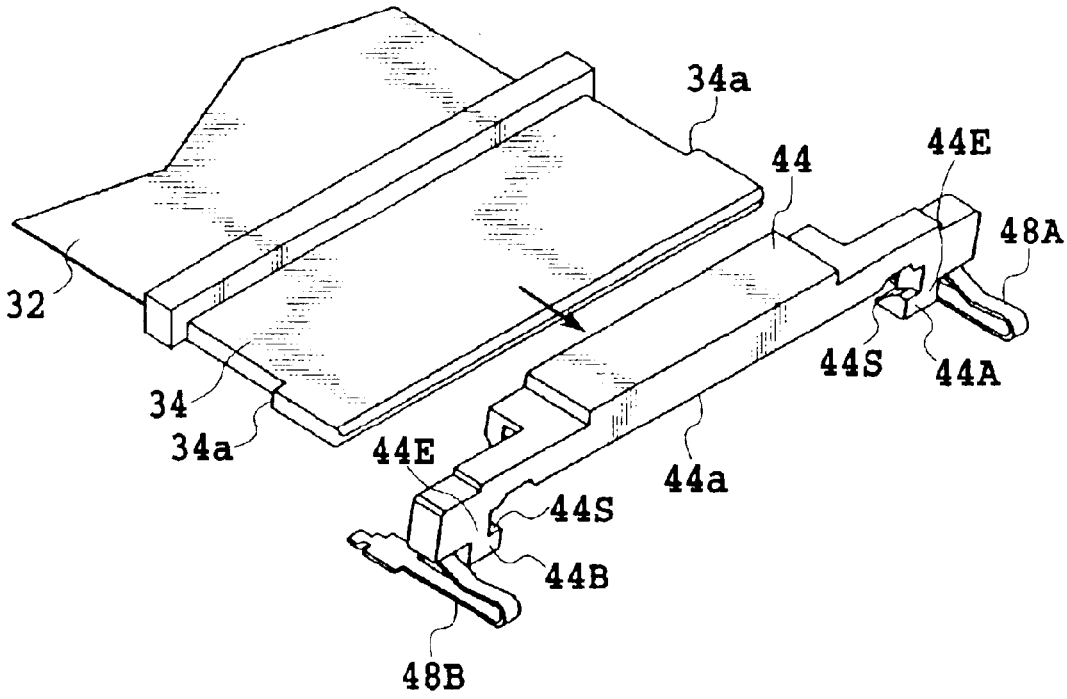
FIG. 4 is a perspective view showing a configuration made up of a cable, a stopper member in the non-connected state in the embodiment shown in FIG. 1.

As shown in FIGS. 3 and 4, the stopper member 44 includes an operating section 44M for selectively being pressed, and the leaf springs 48A and 48B. The leaf springs 48A and 48B are provided, respectively, beneath latch sections 44AL and 44BL formed to have a predetermined step at opposite ends of the operating section 44M.

An end face of the latch section 44AL, 44BL of the operating section 44M extends toward the inside of the cable accommodation portion 40 at a predetermined distance. The upper end surface of the latch section 44AL, 44BL is biased by a spring force of the leaf spring 48A, 48B to touch with the inside surface of the position-restricting section 46R of the above-mentioned plate member 46.

Between the latch sections 44AL and 44BL, there is a space 44*a* for allowing the group of electrodes 32E and the back panel 34 of the flexible printed circuit 32 to pass through the same.

In the latch sections 44AL and 44BL, as shown in FIGS. 3 and 4, a slanted section 44S having a predetermined inclination is formed. A cross-sectional shape of the slanted section 44S is formed to be upward in the right direction so that a front end of-the back panel 34 smoothly moves when the group of electrodes 32E and the back panel 34 in the flexible printed circuit 32 passes through the space 44*a* in the direction shown by an arrow in FIG. 3.

One ends of the leaf springs 48A and 48B are fixed to the lower end surfaces of the latch sections 44AL and 44BL, respectively, as a biasing member.

Each of one ends of the leaf springs 48A and 48B made of elastic metal has a generally horse-shoe-shaped bending portion in an intermediate region and a fixed portion to be press-fit into a groove 38*g* formed at the periphery of the perforation in the other end portion. In this regard, the leaf springs 48A and 48B should not be limited to those made of metal but may be of resin or the like integral with the stopper member 44.

Accordingly, the operating section 44M is biased toward the above-mentioned plate member 46 by the elastic force of the leaf springs 48A and 48B so that the latch sections 44AL and 44BL thereof touch to the position-restraining section 46R to be restricted to the uppermost position. Thus, the lock/unlock mechanism for selectively holding the group of electrodes 32E and the back panel 34 of the flexible printed circuit 32 relative to the connector body 38 is formed of the stopper member 44, the leaf springs 48A, 48B and the step 34*a* of the back panel 43.

Figure 5A:
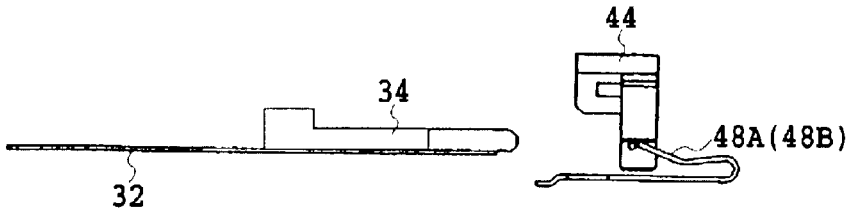
FIG. 5A is a structural drawing showing a configuration made up of the stopper member, one end of the cable in the embodiment shown in FIG. 4.
Figure 5B:
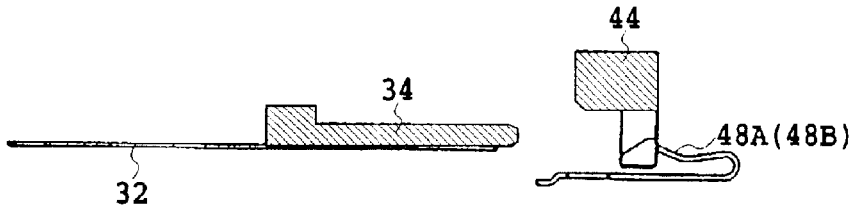
FIG. 5B is a sectional view of FIG. 5A.
Figure 6:
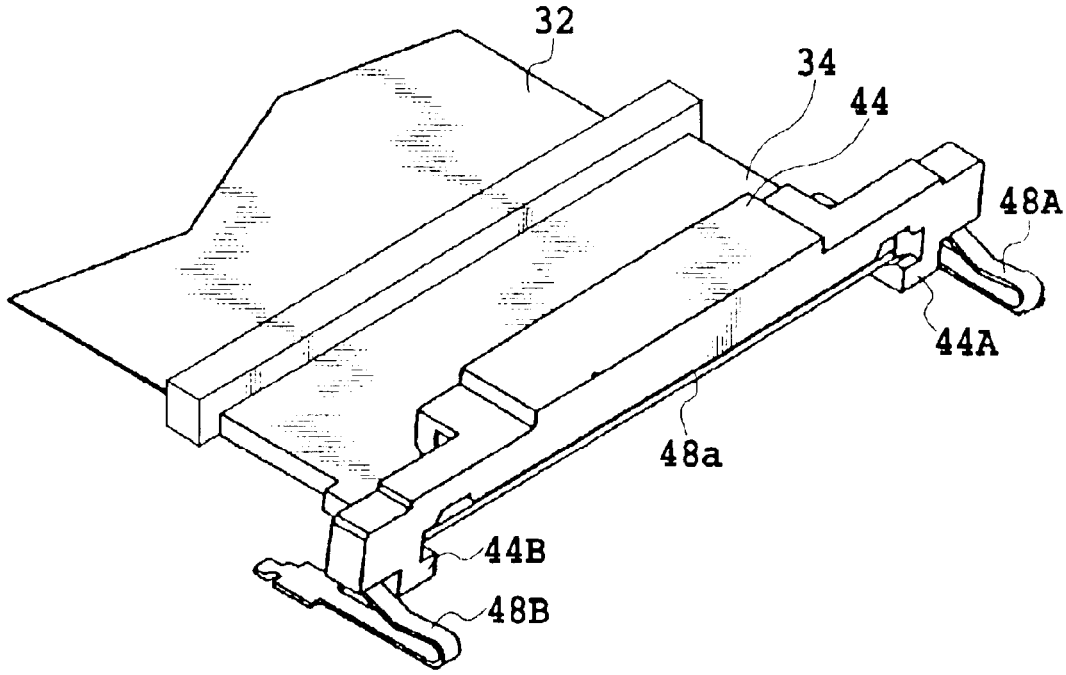
FIG. 6 is a perspective view of the embodiment shown in FIG. 1, illustrating an initial state of the connection of the stopper member with one end of the cable.
Figure 7A:
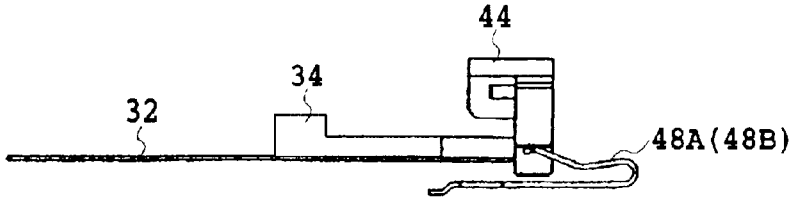
FIG. 7A is a structural drawing showing a configuration made up of the stopper member, one end of the cable in the embodiment shown in FIG. 6.
Figure 7B:
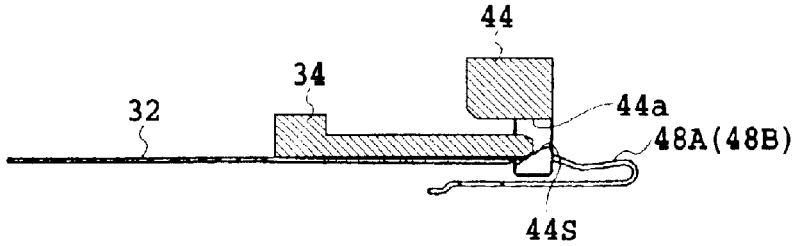
FIG. 7B is a sectional view of FIG. 7A.

In such a structure, when the group of electrodes 32E and the back panel 34 of the flexible printed circuit 32 are connected to the connector body 38, as shown in FIGS. 5A, 5B and 10, the group of electrodes 32E and the back panel 34 of the flexible printed circuit 32 are disposed to be opposite to the opening 38*a* of the connector body 38, and thereafter, as shown in FIGS. 6, 7A, and 7B, inserted into the opening 38*a* toward the space 44*a* of the stopper member 44 in the direction shown by an arrow in FIGS. 3 and 4.

Figure 8:
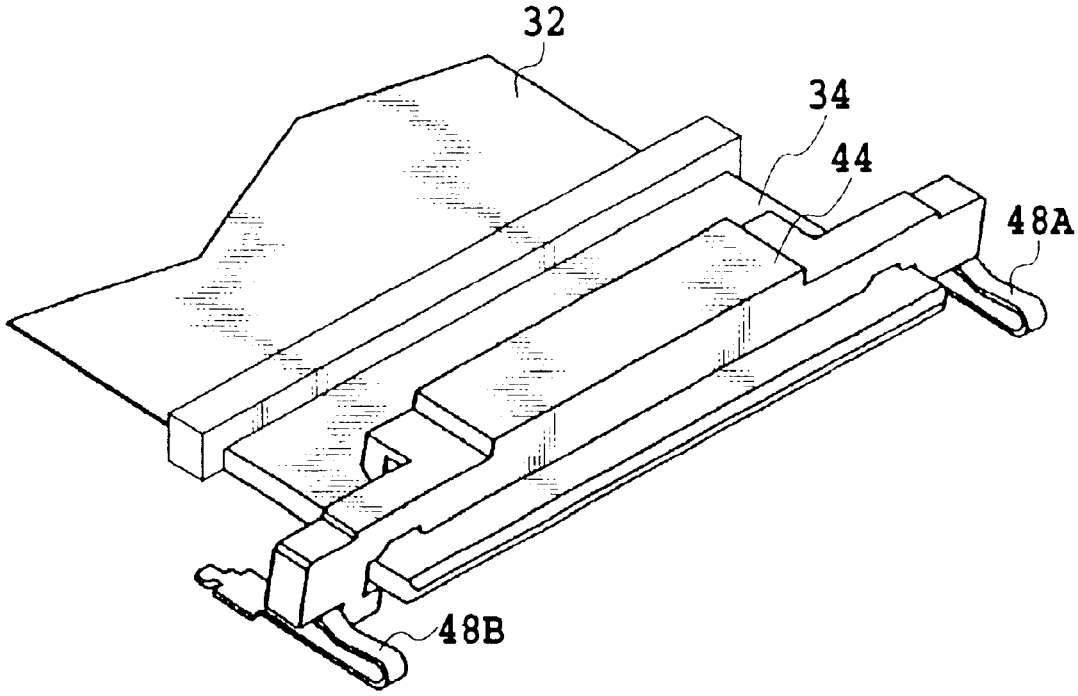
FIG. 8 is a perspective view of the embodiment shown in FIG. 1, illustrating a later state of the connection of the stopper member with one end of the cable.
Figure 9A:
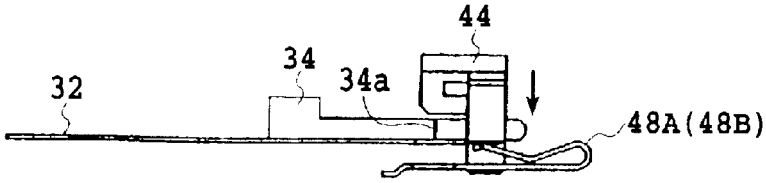
FIG. 9A is a structural drawing showing a configuration made up of the stopper member, one end of the cable in the embodiment shown in FIG. 8.
Figure 9B:
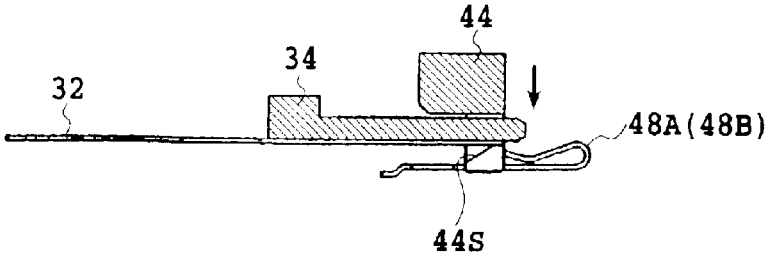
FIG. 9B is a sectional view of FIG. 9A.

Next, as shown in FIGS. 8, 9A and 9B, when the group of electrodes 32E and the back panel 34 in the flexible printed circuit 32 slide on the slanted section 44S to be more deeply inserted, the operating section 44M of the stopper member 44 is lowered in the direction as shown by an arrow.

Figure 1:
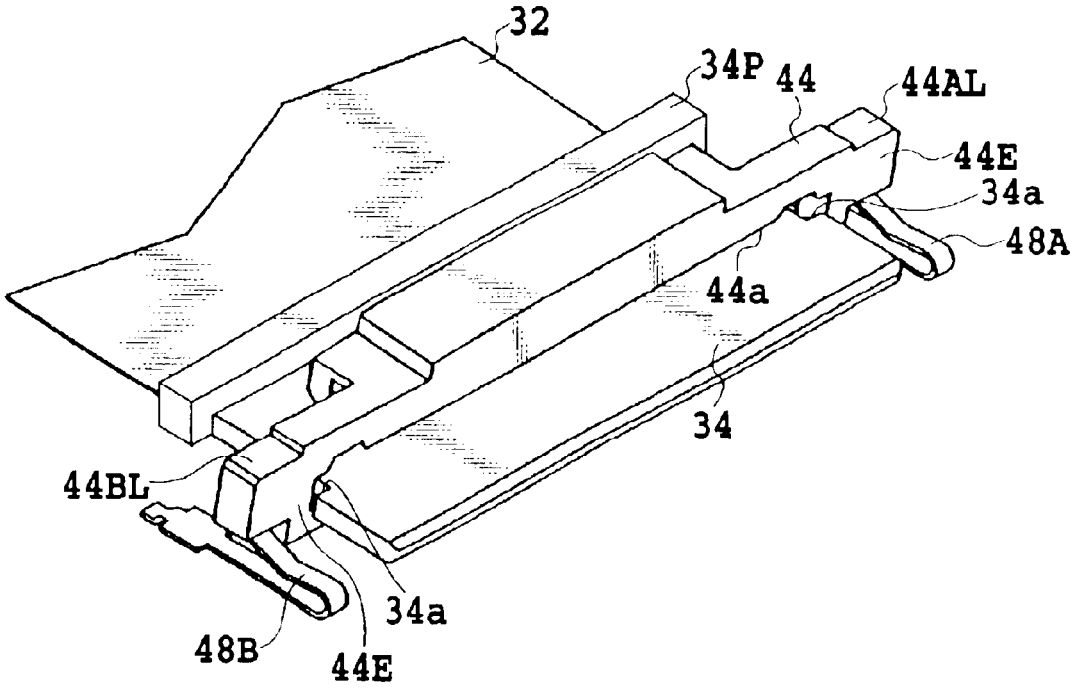
FIG. 1 is a perspective view schematically illustrating an important part of one embodiment of a cable connector according to the present invention with one end of a cable connected completely.
Figure 2A:
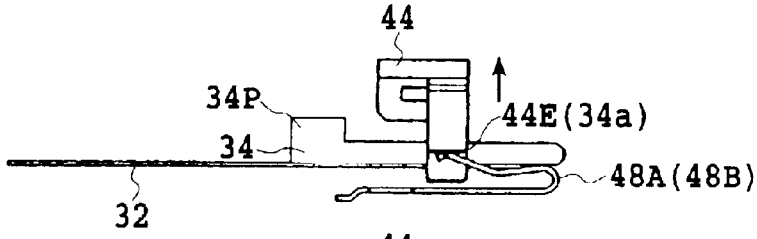
FIG. 2A is a structural drawing showing a configuration made up of a cable, a stopper member with one end of the cable connected in the embodiment shown in FIG. 1.
Figure 2B:
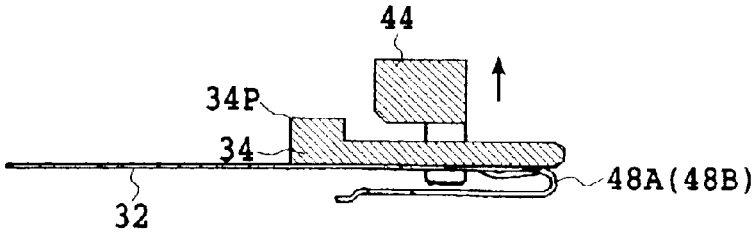
FIG. 2B is a sectional view of FIG. 2A.

Subsequently, when the group of electrodes 32E and the back panel 34 in the flexible printed circuit 32 are inserted as shown in FIGS. 1, 2A and 2B, a front end of the back panel 34 touches to the tail end of the guiding groove 38*gc*, and the end faces 44E of the latch sections 44AL and 44BL slide on the end face of the step 34*a* to establish the mutual engagement.

At that time, the back panel 34 is nipped by the end face 44E of the latch sections 44AL and 44BL and the tail end of the guiding groove 38*gc*. Also, due to the elastic force of the leaf springs 48A and 48B, after the operating section 44M of the stopper member 44 is lifted upward as shown by an arrow, the opposite ends of the operating section 44M of the stopper member 44 (the latch sections 44AL and 44BL), respectively, collide with the inner surface of the position-restricting section 46R of the above-mentioned plate member 46 to generate a click sound as a confirmation sound, for example.

Figure 16:
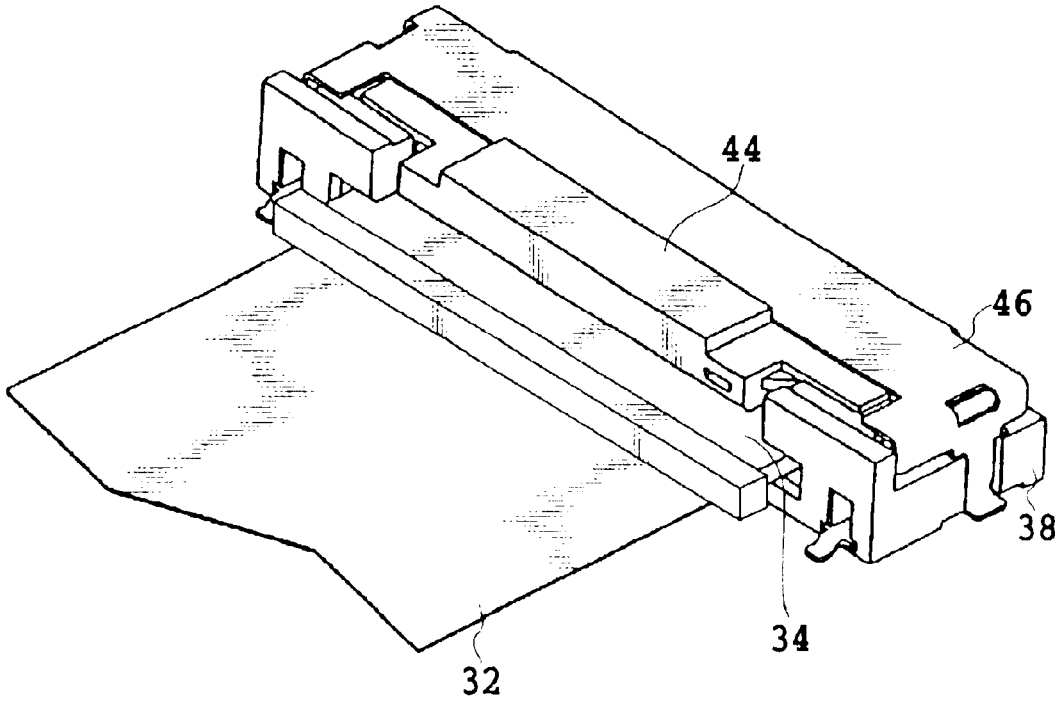
FIG. 16 is a perspective view showing an appearance of one embodiment of the cable connector according to the present invention, together with one end of the cable which have been completely connected.
Figure 17:
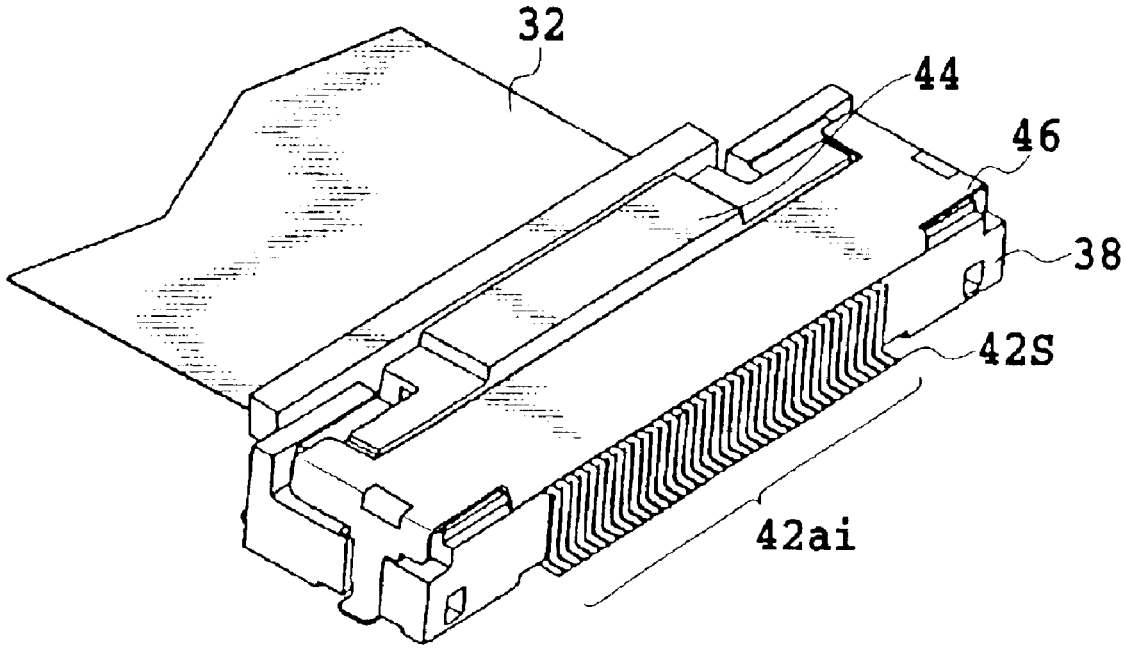
FIG. 17 is a perspective view showing an appearance of one embodiment of the cable connector according to the present invention, together with one end of the cable which have been completely connected.

Thus, it is confirmed that the connection has been completed, and the group of electrodes 32E and the back panel 34 in the flexible printed circuit 32 are correctly positioned by the guiding groove 38*gc*; that is, the electrical connection of the contact terminals 42*ai* of the connector body 38 with the group of electrodes is assuredly obtainable, as shown in FIGS. 15, 16 and 17.

On the other hand, when the group of electrodes 32E and the back panel 34 in the flexible printed circuit 32 are removed from the connector body 38, the operating section 44M is pressed against the elastic force of the leaf springs 48A and 48B, whereby the group of electrodes 32E and the back panel 34 in the flexible printed circuit 32 are withdrawn through the space 44*a* against the elastic force of the contact terminals 42*ai* in the direction opposite to that shown by an arrow in FIGS. 3 and 4. Thus, the group of electrodes 32E and the back panel 34 in the flexible printed circuit 32 are removed from the connector body 38 as shown in FIGS. 10 and 11.

In this regard, while the contact terminals 42*ai* are provided so that the contact section 42*a* is located beneath the group of electrodes 32E of the flexible printed circuit 32 in the above-mentioned embodiment, the contact terminals may have a structure other than the above, in which the contact terminals may be provided so that the group of electrodes 32E of the flexible printed circuit 32 are inserted into the cable accommodating section 40 to have the upward position and brought into contact with the contact terminals.

The present invention has been described in detail with respect to preferred embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. A cable connector comprising:

a cable accommodation portion having contact terminals to be electrically connected to a terminal section provided at one end of a cable together with a portion being engaged, said cable accommodation portion being capable of relatively positioning the one end of said cable relative to said contact terminals and accommodating the one end of said cable therein;

a stopper member disposed in said cable accommodation portion to be movable in the thickness direction of said cable to be connected, having an opening for allowing one end of said cable to pass through said opening, and having an engaging section to be selectively engageable with an end face of said portion being engaged of said cable inserted into said cable accommodation portion at edge of said opening;

a biasing member for biasing said stopper member to maintain the engagement of the engaging section of said stopper member with the end face of said portion being engaged of said cable when the one end of said cable is positioned relative to said contact terminals; and a restricting member for restricting an amount of movement of said stopper member caused by the biasing force of said biasing member, wherein a lock/unlock mechanism for carrying out the selective connection of said terminal section of said cable with said contact terminals of said cable accommodation portion is constituted by said portion being engaged provided at the one end of said cable, said stopper member and said biasing member.

2. A cable connector as claimed in claim 1, wherein said biasing member is a leaf spring which is supported at one end by said stopper member and at the other end by the periphery of said cable accommodation portion.

3. A cable connector as claimed in claim 1, wherein said cable is a flexible printed circuit.

4. A cable connector as claimed in claim 1, wherein said portion being engaged at one end of said cable is a step formed in a back panel.

5. A cable connector as claimed in claim 1, wherein said restricting member is a plate member provided on the outer periphery of said cable accommodation portion.

6. A cable connector, comprising:

a cable accommodation portion comprising contact terminals configured to electrically connect a terminal section of a cable with the cable connector;

a stopper member disposed in the cable accommodation portion configured to move in a direction parallel to the thickness of the cable, the stopper member comprising;

an opening configured to allow one end of the cable to pass through, and an engaging section configured to engage an engaging portion of the cable when the cable is passed through the opening, a biasing member configured to bias the stopper member for maintaining engagement of the engaging section with the engaging portion of the cable; and a restricting member configured to restrict at least some movement of the stopper member caused by the biasing member;

wherein the stopper member, the biasing member, and the engaging portion of the cable are configured to constitute a locking mechanism to selectively lock the cable to the cable connector.

7. A cable connector as claimed in claim 6, wherein the biasing member is a leaf spring that is supported at one end by the stopper member and at the other end by the periphery of the cable accommodation portion.

8. A cable connector as claimed in claim 6, wherein the cable is a flexible printed circuit.

9. A cable connector as claimed in claim 6, wherein the engaging portion of the cable is a step formed in a back panel.

10. A cable connector as claimed in claim 6, wherein the restricting member is a plate member provided on the outer periphery of the cable accommodation portion.

* * * * *